US009469891B2

(12) United States Patent
Okita et al.

(10) Patent No.: US 9,469,891 B2
(45) Date of Patent: Oct. 18, 2016

(54) PRESS-FORMING PRODUCT MANUFACTURING METHOD AND PRESS-FORMING FACILITY

(71) Applicant: Kobe Steel, Ltd., Kobe-shi (JP)

(72) Inventors: Keisuke Okita, Kobe (JP); Junya Naitou, Kobe (JP); Shushi Ikeda, Nagoya (JP)

(73) Assignee: Kobe Steel, Ltd., Kobe-shi (JP)

( * ) Notice: Subject to any disclaimer, the term of this patent is extended or adjusted under 35 U.S.C. 154(b) by 122 days.

(21) Appl. No.: 14/344,516

(22) PCT Filed: Sep. 25, 2012

(86) PCT No.: PCT/JP2012/074571

§ 371 (c)(1),
(2) Date: Mar. 12, 2014

(87) PCT Pub. No.: WO2013/047526

PCT Pub. Date: Apr. 4, 2013

(65) Prior Publication Data

US 2014/0338802 A1 Nov. 20, 2014

(30) Foreign Application Priority Data

Sep. 30, 2011 (JP) ..... 2011-218348

(51) Int. Cl.
*C22C 38/52* (2006.01)
*C22C 38/54* (2006.01)
(Continued)

(52) U.S. Cl.
CPC ..... *C22C 38/54* (2013.01); *B21D 22/208* (2013.01); *C21D 1/673* (2013.01); *C21D 8/0247* (2013.01);
(Continued)

(58) Field of Classification Search
CPC ..... B21D 22/208; C21D 1/18; C21D 1/673; C21D 8/005; C21D 11/005; C21D 2211/008; C21D 9/48
See application file for complete search history.

(56) References Cited

U.S. PATENT DOCUMENTS

2005/0257862 A1 11/2005 Asai et al.
2010/0095733 A1 4/2010 Salamon et al.
2013/0136945 A1* 5/2013 Charest et al. ..... 428/610

FOREIGN PATENT DOCUMENTS

CN 101674901 A 3/2010
JP 2002 102980 4/2002
(Continued)

OTHER PUBLICATIONS

Aida, K., "New Automobile Production Line—Hot Press Forming and Laser Beam Machining", Forum on Laser Material Processing, pp. 42-49, (2010) (with English translation).
(Continued)

*Primary Examiner* — Veronica F Faison
(74) *Attorney, Agent, or Firm* — Oblon, McClelland, Maier & Neustadt, L.L.P.

(57) ABSTRACT

Provided is a press-forming product manufacturing method of manufacturing a forming product having satisfactory formability for a drawing process by press-forming a metal sheet using a press-forming tool with high productivity, including: heating the metal sheet to a transformation temperature $Ac_1$ or more; cooling the metal sheet to 600° C. or lower; forming the metal sheet by a forming tool; ending the forming process at a martensite transformation start temperature Ms or more; taking out the metal sheet from the forming tool; and cooling the metal sheet.

5 Claims, 6 Drawing Sheets

(51) Int. Cl.

| | |
|---|---|
| ***B21D 22/20*** | (2006.01) |
| ***C21D 1/673*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/50*** | (2006.01) |
| *C21D 9/48* | (2006.01) |

(52) U.S. Cl.
CPC ..... *C22C 38/001* (2013.01); *C22C 38/02* (2013.01); *C22C 38/04* (2013.01); *C22C 38/06* (2013.01); *C22C 38/42* (2013.01); *C22C 38/50* (2013.01); *C21D 9/48* (2013.01)

(56) References Cited

FOREIGN PATENT DOCUMENTS

| | | |
|---|---|---|
| JP | 2005-288528 A | 10/2005 |
| JP | 2005 329449 | 12/2005 |
| JP | 2007 275937 | 10/2007 |
| JP | 2010 520058 | 6/2010 |

OTHER PUBLICATIONS

International Search Report Issued Dec. 11, 2012 in PCT/JP12/074571 filed Sep. 25, 2012.
Written Opinion of the International Searching Authority Issued Dec. 11, 2012 in PCT/JP12/074571 filed Sep. 25, 2012.
Extended European Search Report issued May 4, 2015 in Patent Application No. 12837594.6.

* cited by examiner

※ CONVEYANCE 1: FROM HEATING FURNANCE TO COOLING UNIT (COOLING ZONE)
※ QUENCHING BEFORE PRESSING: COOLING AT COOLING UNIT (COOLING ZONE)
※ CONVEYANCE 2: FROM COOLING UNIT (COOLING ZONE) TO PRESSING MACHINE
※ MOLDING: MOLDING AT MOLDING MACHINE
※ OPEN COOLING: COOLING AFTER EXTRACTION FROM MOLD, AFTER MOLDING

PRESS-FORMING PRODUCT MANUFACTURING METHOD AND PRESS-FORMING FACILITY

TECHNICAL FIELD

The present invention relates to a method of manufacturing a hot press-forming product that needs a strength used in a structure member of an automobile component and a facility used for the manufacturing method. Particularly, the present invention relates to a method of manufacturing a press-forming product capable of obtaining a predetermined strength by performing a heat treatment and a shaping process when a preliminarily heated metal sheet (blank) is formed in a predetermined shape and a facility used for the manufacturing method. More particularly, the present invention relates to a press-forming product manufacturing method of manufacturing a press-forming product with high productivity without causing a breakage or a crack during a press-forming process and a facility used for the manufacturing method.

BACKGROUND ART

As one of countermeasures for the improvement of fuel efficiency of an automobile originated from a global environmental problem, a vehicle body has been decreased in weight. For this reason, there is a need to improve the strength of a metal sheet used in the automobile as much as possible. However, when the strength of the metal sheet is improved generally in order to decrease the weight of the automobile, an elongation EL or a value r (Lankford value) decreases, and hence a shape freezing property or press-formability is degraded.

In order to solve such a problem, a hot press-forming method (a so-called "hot pressing method") that ensures a strength after a forming process is employed to manufacture a component, and the hot press-forming method is performed in a manner such that a metal sheet (blank) is heated to a predetermined temperature (for example, an austenite-phase temperature) so as to decrease the strength (that is, to facilitate the forming process), and is formed by a forming tool having a low temperature (for example, a room temperature) compared to the metal sheet (the processing target), thereby performing a shaping process and a supper-cooling heat treatment (quenching) using a temperature difference therebetween (for example, Patent Document 1).

According to such a hot pressing method, since the metal sheet is formed in a low-strength state, spring-back decreases (with a satisfactory shape freezing property), and a tensile strength becomes 1500 MPa by the quenching process. Furthermore, such a hot pressing method is called various names such as a hot forming method, a hot stamping method, a hot stamp method, and a die-quench method other than the hot pressing method.

FIG. 1 is a schematic explanatory diagram illustrating a configuration of a forming tool that is used to perform the above-described hot press-forming process. In the drawing, Reference Numeral 1 indicates a punch, Reference Numeral 2 indicates a die, Reference Numeral 3 indicates a blank holder, Reference Numeral 4 indicates a metal sheet (blank), BHF indicates a folding force, rp indicates a punch shoulder radius, rd indicates a die shoulder radius, and CL indicates a clearance between a punch and a die. Further, in these components, the punch 1 and the die 2 are respectively provided with passageways 1*a* and 2*a* through which a cooling medium (for example, water) may pass, and these members are cooled when the cooling medium passes through the passageways.

A hot press-forming facility including a press-forming machine having the above-described forming tool configuration is disclosed in, for example, Non-Patent Document 1. The facility includes a heating furnace that heats and softens a metal sheet, a device that conveys the heated metal sheet, a press-forming machine that press-forms the metal sheet, and a device that performs a trimming process (a correction process for obtaining a final shape by a laser or the like) on the forming product (see FIG. 2 below).

When a hot pressing process (for example, a deep drawing process) is performed by using such a forming tool, the forming process starts while the blank (the metal sheet) 4 is heated and softened (a direct method). That is, the metal sheet 4 is pressed into a hole (between the dies 2 of FIG. 1) of the die 2 by the punch 1 while the high-temperature metal sheet 4 is clamped between the die 2 and the blank holder 3, and is formed in a shape corresponding to the outer shape of the punch 1 while the outer diameter of the metal sheet 4 is decreased. Further, the punch and the die are cooled along with the forming process so that heat is emitted from the metal sheet 4 to the forming tool (the punch 1 and the die 2), and the punch and the die are further cooled while being held at a forming bottom dead center (a time point at which the front end of the punch is located at the deepest portion: the state shown in FIG. 1) so that the material is quenched (a die-quench process). When such a forming method is performed, a forming product of 1500 MPa with good dimensional precision may be obtained, and a forming load may be reduced compared to the case where a component having the same strength is formed by a cold forming process, so that the capacity of the pressing machine decreases. Such a forming method is also disclosed in, for example, Patent Document 2.

CITATION LIST

Patent Document

Patent Document 1: JP 2002-102980 A
Patent Document 2: JP 2007-275937 A

Non-Patent Document

Non-Patent Document 1: "New laser processing and automobile production line hot press molding": Kazuo Aida (AP&T), FORUM on LASER MATERIAL PROCESSING 2010, pp. 42-49

SUMMARY OF THE INVENTION

However, in the hot pressing method introduced so far, the pressing process was generally performed near 700 to 900° C., and the metal sheet was cooled to about 200° C. inside the forming tool so as to be quenched. For this reason, there was a need to hold the forming tool at the forming bottom dead center (the time point at which the front end of the punch was located at the deepest portion) for a certain time, and hence the time necessary for the die-quenching was long. For this reason, the number of pressing operations for 1 minute (spm: stroke/minute) was small as two to six times. As a result, the forming tool operation efficiency was low, and the productivity was poor.

For this reason, a so-called indirect method is proposed in which a metal sheet is formed in a near net state (a state where the metal sheet substantially becomes a forming product) by a cold pressing machine and is heated and die-quenched. However, in this method, the number of forming processes increases, and hence there is a demerit that the forming time is extended. Accordingly, there has been demanded a technique that further improves the productivity according to a direct method having a small number of forming processes.

The present invention is made in view of such circumstances, and an object thereof is to provide a method of manufacturing a press-forming product having a desired strength with high productivity without causing a breakage or a crack during a press-forming process and to provide a press-forming facility suitable for the manufacturing method.

In order to attain the above-described object, according to the present invention, there is provided a press-forming product manufacturing method of manufacturing a forming product by press-forming a metal sheet using a press-forming tool, including: heating the metal sheet to a transformation temperature $Ac_1$ or more; cooling the metal sheet to 600° C. or lower; forming the metal sheet by a forming tool; ending the forming process at a martensite transformation start temperature Ms or more; taking out the metal sheet from the forming tool; and cooling the metal sheet.

According to an embodiment of the present invention, the forming process may be performed by a mechanical press-forming process or a hydraulic press-forming process having a pressing speed of 100 mm/second or more, and the cooling process to 600° C. or less may be performed by clamping the metal sheet between metal members or ejecting a gas and/or a mist.

Further, in order to attain the above-described object, according to the present invention, there is provided a press-forming facility that includes a heating furnace and a press-forming machine and is used to manufacture a forming product in a manner such that a metal sheet is heated to a transformation temperature $Ac_1$ or more in the heating furnace, and the metal sheet is press-formed by a press-forming machine, wherein a cooling unit that rapidly cools the heated metal sheet is provided inside the heating furnace or between the heating furnace and the press-forming machine, and the press-forming machine is a mechanical pressing machine or a hydraulic pressing machine having a pressing speed of 100 mm/second or more.

The present invention also includes a press-forming product that is obtained by the press-forming facility.

According to the present invention, the metal sheet is heated, the metal sheet is cooled to a predetermined temperature, the metal sheet is subjected to the press-forming process, the press-forming process ends at the martensite transformation start temperature Ms or more, the metal sheet is taken out from the forming tool, and the metal sheet is subjected to the cooling process. For this reason, the forming tool operation efficiency may be improved, and hence the press-forming product may be manufactured with high productivity. Accordingly, the manufacturing cost of the hot stamped component may be reduced.

Further, according to the present invention, the cooling unit that rapidly cools the heated metal sheet is provided inside the heating furnace or between the heating furnace and the press-forming machine, and the mechanical press-forming machine or the high-speed hydraulic pressing machine is provided. For this reason, when the press-forming process is performed on the blank that is cooled to 600° C. or lower before the press-forming process by the facility, the forming tool operation efficiency may be improved, and hence the press-forming product may be manufactured with high productivity.

According to the present invention, it is possible to provide the satisfactory press-forming product having a desired strength with high productivity without causing a breakage or a crack during the forming process.

DESCRIPTION OF EMBODIMENTS

The present inventors have conducted various examinations in order to manufacture a satisfactory press-forming product with high productivity by heating and press-forming a metal sheet.

First, the present inventors were interested in a press-forming process. In the related art, since the metal sheet was formed and cooled by a quenching process inside a forming tool, the metal sheet needed to be held at a forming bottom dead center for a predetermined time. For example, in Patent Document 2, a punch was stopped at the forming bottom dead center after the press-forming process, and the temperature of the metal sheet was decreased by emitting the heat of the metal sheet to the forming tool (a cooling process at the bottom dead center). For this reason, the forming tool operation efficiency was poor, and the productivity was also poor.

When the metal sheet is extracted from the forming tool for the cooling process without directly performing the quenching process on the metal sheet formed in the forming tool, the metal sheet does not need to be held at the forming bottom dead center, and hence the time (the forming tool occupying time) necessary for the pressing process is shortened. Accordingly, the forming tool operation efficiency may be improved, and the productivity may be improved. Therefore, the present inventors have more carefully examined the forming condition.

As a result, when a forming process is performed in a manner such that a metal sheet is heated, is rapidly cooled to a temperature zone of 600° C. or lower, and is formed by a forming tool instead of a forming process in which a metal sheet (blank) is heated and is directly formed, the forming process ends at the temperature of a martensite transformation start temperature Ms or more, and a cooling process is performed after the metal sheet is taken out from the forming tool, the productivity may be drastically improved while maintaining a satisfactory formability without causing a crack or the like. In this way, the present invention is contrived. Hereinafter, the background of the present invention will be described in detail.

Figure 8:
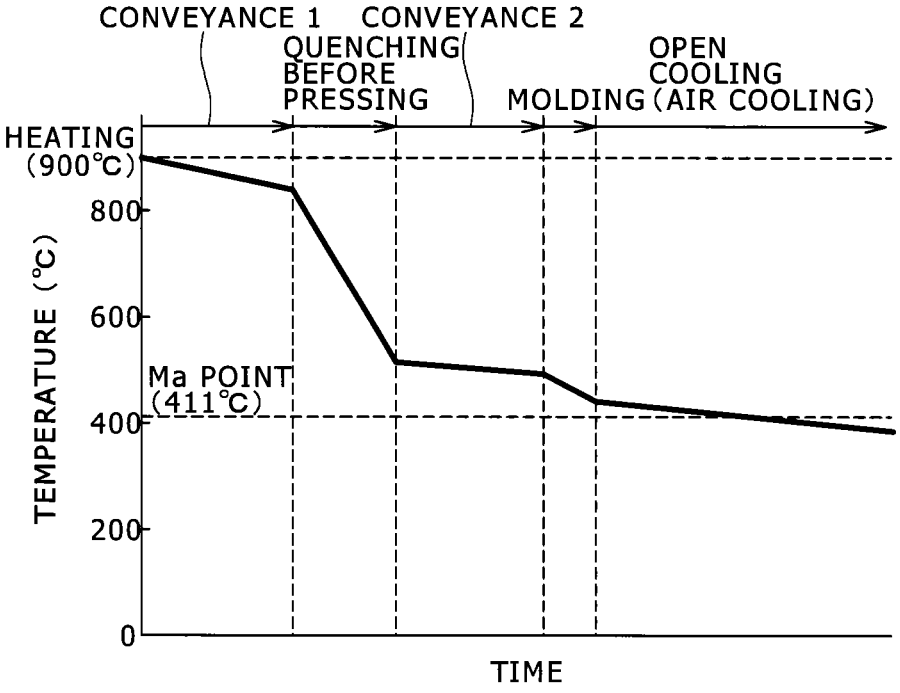
FIG. 8 is a graph illustrating a relation between a time and a heating pattern when a press-forming process is performed by using the press-forming facility of the present invention.

The present inventors first heated a metal sheet having a chemical composition shown in Table 1 below at 900° C. (where the metal sheet has a transformation temperature $Ac_1$: 718° C., a transformation temperature $Ac_3$: 830° C., and a martensite transformation start temperature Ms: 411° C.), rapidly cooled the metal sheet to 600° C. or lower, and drew the metal sheet by using a forming tool (a mechanical pressing machine) shown in FIG. 1 according to the above-described order. As a result, it is proved that the deep drawing process may be performed up to the forming bottom dead center. Further, it is proved that the quenching process may be sufficiently performed when the forming process ends at the martensite transformation start temperature Ms and the metal sheet is cooled while being taken out from the forming tool (where the heating pattern of the present invention is shown in FIG. 8). Accordingly, since the forming tool occupying time may be largely shortened compared to the related art in which the quenching process is performed on the metal sheet inside the forming tool, the number of pressing operations for 1 minute (spm: stroke/minute) may be set to, for example, eight to fifteen times, and hence the productivity may be drastically improved compared to the case of the related art in which the pressing operation is performed two to six times.

In the embodiment of the present invention, there is a need to facilitate the forming process by heating the metal sheet to the transformation temperature $Ac_1$ or more. Furthermore, the transformation temperature $Ac_1$ or more may be the temperature of the two-phase region of the transformation temperature $Ac_1$ to the transformation temperature $Ac_3$ or may be the temperature of the single region of the transformation temperature $Ac_3$ or more. It is desirable that the upper limit of the heating temperature be about 1000° C. When the upper limit becomes higher than 1000° C., oxidized scales are noticeably generated (for example, 100 μm or more), and hence there is a concern that the sheet thickness of the (de-scaled) forming product may become thinner than a predetermined thickness.

Figure 2:
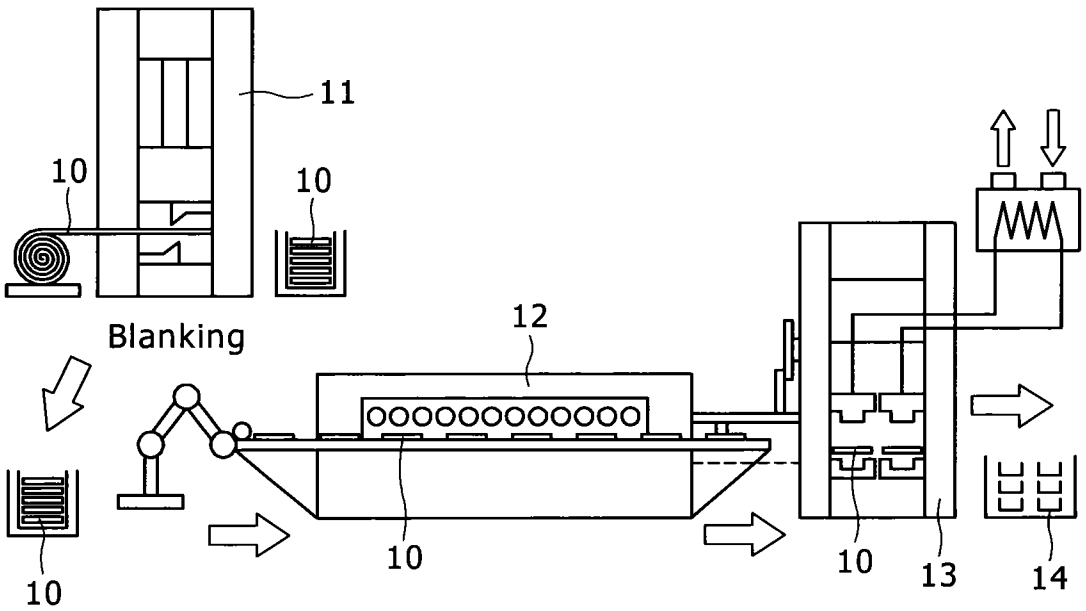
FIG. 2 is a schematic explanatory diagram illustrating a configuration example of a hot press-forming facility of the related art.
Figure 7:
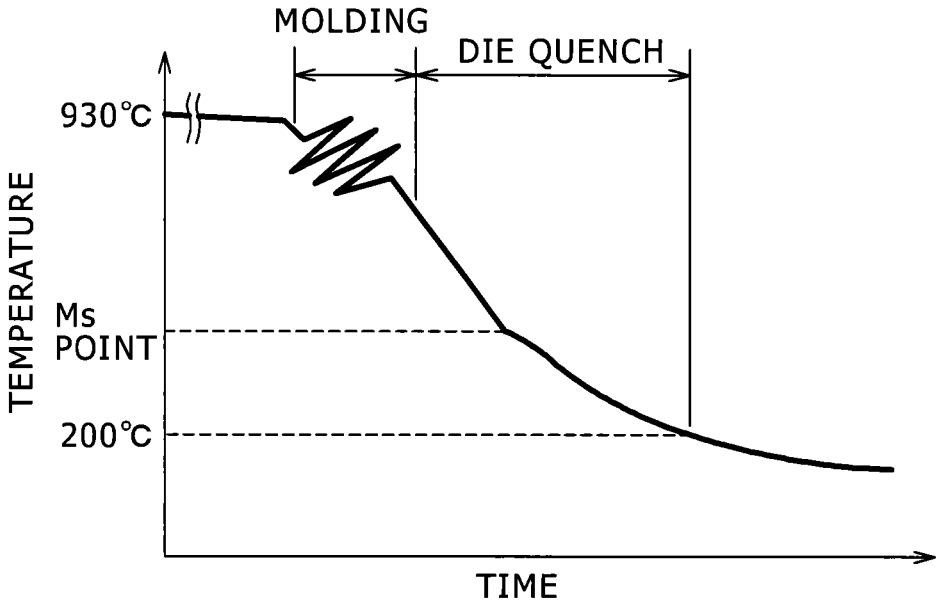
FIG. 7 is a graph illustrating a relation between a time and a heating pattern when a press-forming process is performed by using the press-forming facility of the related art.

Incidentally, an existing hot press line generally has a configuration (a facility configuration) shown in FIG. 2 (which is a schematic explanatory diagram). That is, as shown in FIG. 2, a coil-shaped metal sheet 10 is cut by a cutout machine 11 (Blanking), is heated inside a heating furnace 12, and then is conveyed to a press-forming machine 13 so as to perform a press-forming process thereon, thereby obtaining a press-forming product 14 (where the heating pattern of the related art is shown in FIG. 7).

In the present invention, the forming process is performed on the metal sheet after the metal sheet is rapidly cooled to 600° C. or lower instead of the configuration in which the metal sheet is heated to a predetermined temperature by the heating furnace and is directly conveyed to the press-forming machine so as to perform the forming process thereon. When the forming start temperature exceeds 600° C., the quenching time after the forming process is extended. Accordingly, the productivity is degraded, and the sufficient strength may not be obtained without a quenching process. Further, since the formability is degraded, it is difficult to perform a drawing process or form a product with a complex shape. The desirable forming start temperature is 580° C. or lower and more desirably 550° C. or lower. Meanwhile, when the forming start temperature is decreased too much, the metal sheet is hardened already at the forming start step, and hence satisfactory formability may not be exhibited. Accordingly, the forming start temperature is set to be higher than the point Ms. More desirably, the forming start temperature is set to be equal to or higher than a temperature of a value (the point Ms+30° C.). The cooling speed (the average cooling speed) until the heated metal sheet is cooled to 600° C. or lower needs to the cooling ability of 30° C./second or more in that the sufficient strength may not be ensured or the productivity may be degraded at the slow cooling speed. It is desirable to cool the metal sheet at 80° C./second or more.

Figure 3:
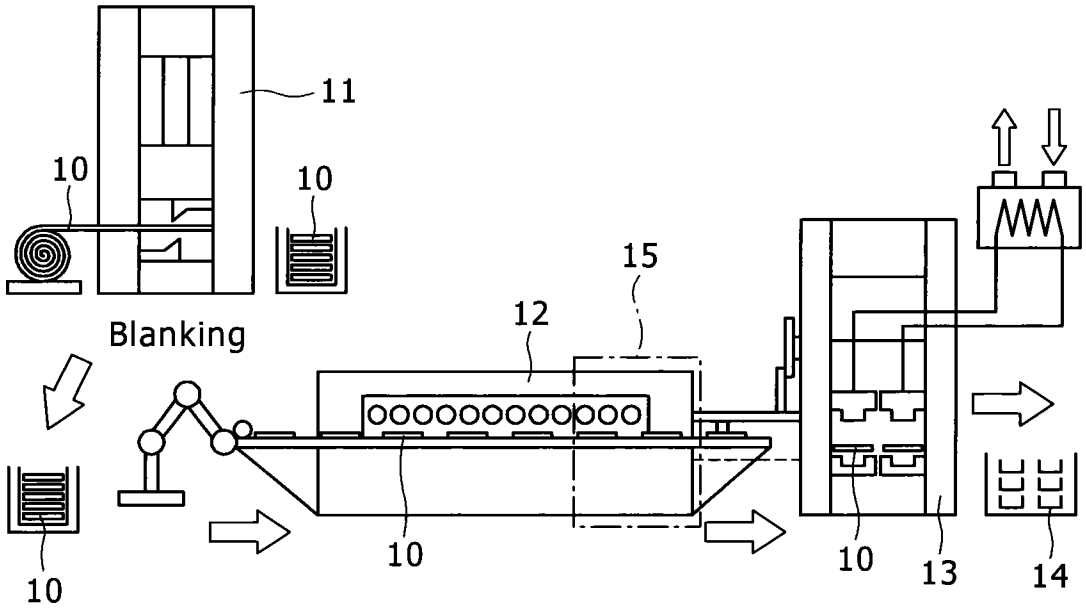
FIG. 3 is a schematic explanatory diagram illustrating an example of a press-forming facility of the present invention.

In a case where the metal sheet is heated and is cooled to 600° C. or lower, for example, the facility configuration shown in FIGS. 3 to 6 (which are schematic explanatory diagrams) may be employed (in FIG. 3, the same reference numeral is given to the constituent corresponding to FIG. 2). In the press-forming facility of the present invention, the heating furnace 12 may include therein a cooling unit 15 that is attached to the heating furnace 12, and cools the metal sheet 10 until the metal sheet moves from the heating furnace 12 to the press-forming machine 13. The cooling unit 15 may be provided between the heating furnace 12 and the press-forming machine 13 (for example see the "cooling unit" or the "cooling zone" of FIGS. 4 to 6). In the cooling process using the cooling unit 15, the cooling process may be performed by, for example, the following methods (1) to (4) (or the combination thereof).

Figure 4:
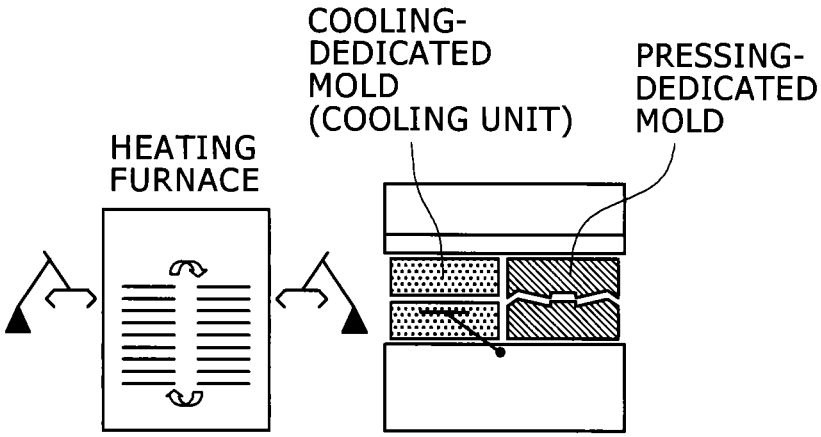
FIG. 4 is a schematic explanatory diagram illustrating a configuration example of a cooling unit of the press-forming facility of the present invention.
Figure 5:
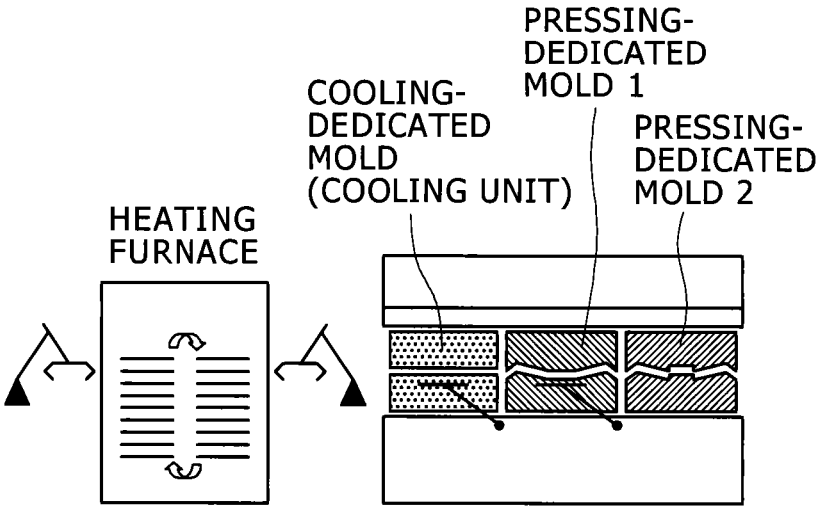
FIG. 5 is a schematic explanatory diagram illustrating a configuration example of another cooling unit of the press-forming facility of the present invention.

(1) A heat-emitting process is performed by providing a unit (for example, a cooling unit that is configured to clamp a metal sheet by a metal member such as a metal plate or a metal roll) that contacts metal as a cooling medium (for example, FIGS. 4 and 5).

(2) A gas-jet cooling process is performed by providing a gas cooling unit.

Figure 6:
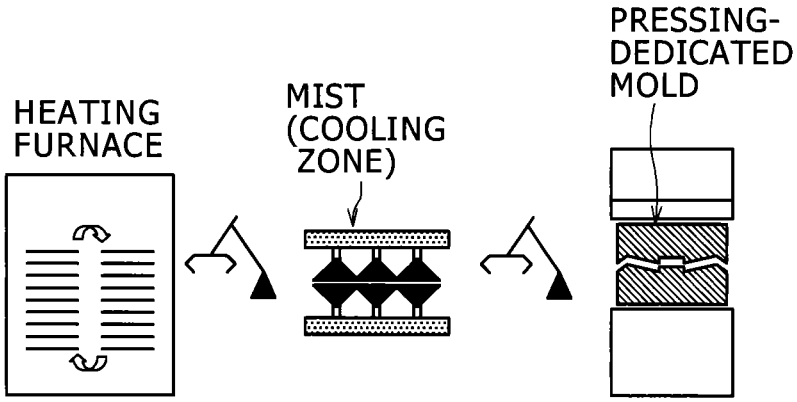
FIG. 6 is a schematic explanatory diagram illustrating a configuration example of still another cooling unit of the press-forming facility of the present invention.

(3) A cooling process is performed by providing a mist cooling unit (for example, FIG. 6).

(4) A cooling process is performed by providing a dry ice shot-blasting unit (the cooling process is performed by causing granule dry ice to collide with a blank material).

In the cooling using the cooling facility (the cooling unit) of the present invention, it is desirable to control the atmosphere along with the cooling process. When the atmosphere is controlled (so that the atmosphere becomes, for example, the atmosphere of nitrogen or argon), the surface oxidization of the metal sheet may be prevented. Further, when the temperature is set to be comparatively low, the surface oxidization may be suppressed.

FIG. 4 is a schematic diagram illustrating a configuration example of a cooling unit and illustrates a facility that cools a heated metal sheet while the metal sheet is clamped between the metal members. The heated metal sheet is conveyed from a heating furnace to a quenching plane forming tool (a cooling-dedicated forming tool), and is pressed by the forming tool, so that the metal sheet is rapidly cooled at a predetermined temperature (where the metal sheet is cooled while being clamped between the metal members). After the metal sheet is cooled, the metal sheet may be conveyed to a forming tool (a pressing-dedicated forming tool) having a predetermined shape so as to perform a press-forming process thereon. As for the shape of the cooling-dedicated forming tool, it is desirable that the metal sheet contact surface of the forming tool be flat in order to uniformly cool the metal sheet. However, in order to have a temperature distribution or to perform a slightly preliminary forming process, the metal sheet contact surface does not need to be flat, and the metal sheet contact surface may have a step or a curvature.

The forming process may be performed after the cooling process is performed to a predetermined temperature in the above-described cooling unit (where the cooling process is completed until the forming process starts). However, the forming process may be continuously performed while being cooled by the forming tool even after the forming process starts.

Further, the press-forming process may be performed while being divided into a plurality of times. For example, as shown in FIG. 5, a method may be employed in which the metal sheet is cooled to a predetermined temperature by the plane forming tool (the cooling-dedicated forming tool) and is sequentially press-formed by a forming tool having a predetermined shape so that the metal sheet is formed in a complex shape (by using a pressing-dedicated forming tool 1 and a pressing-dedicated forming tool 2). Further, a shape freezing step or a die trimming and piercing step may be further added.

In the present invention, it is desirable that the press-forming machine 13 that performs a press-forming process on the metal sheet be configured as a machine press (hereinafter, referred to as a mechanical press) that performs a press-forming process by a mechanical driving force generated by a pressure generating mechanism in that the mechanical press has a fast pressing speed (for example, 100 mm/second or more), does not need to be held at the bottom dead center, and has cheap installation cost from the viewpoint in which the pressing time is shortened. However, a liquid-pressure press (for example, a hydraulic press) that uses a liquid pressure generated by a pressure generating mechanism or a hydraulic pressing machine having a pressing speed of 100 mm/second or more may be used. In a hydraulic pressing machine with such a pressing speed, the forming tool is not substantially held at the bottom dead center, and hence the forming tool operation efficiency may be improved.

In the related art, since the quenching process is performed on the metal sheet inside the forming tool, a liquid-pressure press is needed as a unit that holds the forming tool at the forming bottom dead center. However, in the present invention, since the cooling process is performed after the metal sheet is taken out from the forming tool, the liquid-pressure press having a comparatively slow pressing speed used in the related art does not need to be used. In a case where the mechanical press or the hydraulic press having a pressing speed of 100 mm/second or more is used, the time necessary for the pressing process may be shortened. Further, in the present invention, since the forming tool is not held at the forming bottom dead center for the quenching process, the number of pressing operations for 1 minute (spm: stroke/minute) may be improved, and hence the forming tool operation efficiency is satisfactory.

As the mechanical pressing machine, various slide driving mechanisms may be used. For example, a crank press, a knuckle press, a link press, a friction press, or the like may be used. Further, FIGS. 4 and 5 are schematic diagrams illustrating a transfer pressing machine including a cooling-dedicated forming tool for cooling a metal sheet inside a device and a pressing-dedicated forming tool for performing a forming process, but the press-forming machine is not limited thereto.

The forming end temperature is set to the martensite transformation start temperature Ms or more. This is because the formability may be degraded when the martensite transformation occurs during the forming process. Accordingly, the forming end temperature is the point Ms or more and more desirably a value (the point Ms+10° C.) or more.

The quenching method after the end of the forming process is not particularly limited. For example, the formed steel sheet may be cooled after being extracted from the forming tool or the formed steel sheet may be cooled by various cooling units of (1) to (4) while the cooling speed is controlled (for example, 10 to 200° C./second). From the viewpoint of ensuring a desired strength by the quenching process, a method is desirable in which the formed steel sheet is extracted from the forming tool and is cooled by various cooling units of (1) to (4) at 30° C./second or more.

Figure 1:
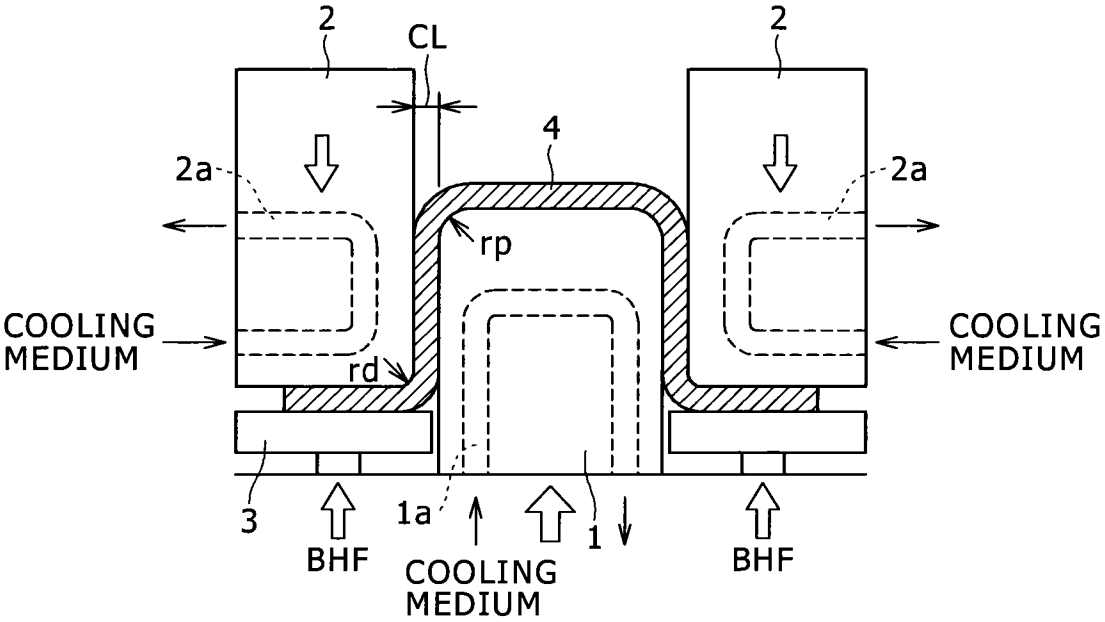
FIG. 1 is a schematic explanatory diagram illustrating a configuration of a forming tool that is used to perform a hot press-forming process.

The hot press-forming product manufacturing method of the present invention may be applied to not only the case where a hot press-forming product having a simple shape is manufactured as shown in FIG. 1, but also the case where a forming product having a comparatively complex shape is manufactured.

The effect of the method of the present invention is noticeably exhibited in a case where the forming process (that is, the drawing process) is performed by using the forming tool having a folding force. However, the method of the present invention is not limited to the drawing process using the folding pressure, but includes a case where a normal press-forming process (for example, a stretch forming process) is performed. Even in a case where the forming product is manufactured according to such a method, the effect of the present invention is attained.

According to the present invention, it is possible to manufacture a satisfactory press-forming product having a predetermined strength without causing a breakage or a crack during a forming process.

Hereinafter, the effect of the present invention will be described in more detail by examples. However, the examples below do not limit the present invention, and all modifications in design are included in the technical scope of the present invention.

Priority is claimed on Japanese Patent Application No. 2011-218348, filed on Sep. 30, 2011. The entire content disclosed in Japanese Patent Application No. 2011-218348, filed on Sep. 30, 2011 is incorporated herein by reference.

EXAMPLE

Example 1

Nos. 1 to 3

A metal sheet (a circular blank having a thickness of 1.0 mm and a diameter of 100 mm) having a chemical composition shown in Table 1 was heated to 900° C. (where the steel sheet has a transformation temperature $Ac_1$ of 718° C., a transformation temperature $Ac_3$ of 830° C., and a martensite transformation start temperature Ms of 411° C.) by a press-forming facility including a cooling facility (a cooling unit or a cooling zone) shown in FIGS. 3, 4, and 6, was conveyed to the cooling facility, was cooled to 600° C. or lower under a predetermined condition (the "quenching speed" and the "quenching time") by a cooling method (a "quenching method") shown in Table 2, was conveyed to the pressing machine, and was subjected to a cylindrical deep drawing process by using a forming tool [a cylindrical forming tool (a cylindrical die and a cylindrical punch) having a diameter of 50 mm]. At this time, the metal sheet was formed by a mechanical press while a cooling medium (water) was caused to pass into the punch and the die so as to cool the forming tool (under the condition in which the forming time was 1 second, the forming speed was 100 mm/second, and the distance from the top dead center (the time point at which the front end of the punch was located at the position before the forming process started) to the forming bottom dead center was 100 mm). The conveying condition, the quenching condition of the cooling facility, and the press-forming condition at this time are set as below.

Furthermore, the "quenching speed" of the "quenching condition of the cooling facility" was calculated in a manner such that the cooling curve of each quenching method was measured in advance and the speed was calculated based on the measurement value. Further, the pressing start temperature was adjusted by controlling the quenching time in which the metal sheet was extracted from the heating furnace and was subjected to the press-forming process based on the cooling curve. The measurement of the cooling curve was performed in a manner such that a change in temperature with time was measured while the metal sheet having a thermocouple attached thereto was rapidly cooled according to each quenching method without the press-forming process.

<Conveying Condition>

The conveying time from the heating furnace to the cooling unit (the cooling zone) and the conveying time from the cooling unit (the cooling zone) to the pressing-dedicated forming tool are respectively set to 3 seconds.

<Quenching Condition of Cooling Facility>

Quenching speed (gas jet): 85° C./second (using He gas)

Quenching speed (metal clamping): 160° C./second (using copper alloy for cooling forming tool)

Quenching speed (mist ejection): 310° C./second (mixture of air and water)

<Press-Forming Condition>

Folding force: 3 tons

Die shoulder radius rd: 5 mm

Punch shoulder radius rp: 5 mm

Clearance CL between punch and die: 0.15/2+1.0 (steel sheet thickness) mm

Forming height: 25 mm

Pressing machine: mechanical press (manufactured by AIDA Corporation. 80t crank press)

Furthermore, the transformation temperature $Ac_1$, the transformation temperature $Ac_3$, and the point Ms are obtained based on the following equations (1) to (3) (for example, see "Heat treatment" 41(3), 164 to 169, 2001 Kunitake stand wax and "Prediction by empirical formula of transformation temperatures $Ac_1$, $Ac_3$, and Ms").

$$\text{Transformation temperature } Ac_1(^\circ\text{ C.})=723+29.1\times[Si]-10.7\times[Mn]+16.9\times[Cr]-16.9\times[Ni] \quad (1)$$

$$\text{Transformation temperature } Ac_3(^\circ\text{ C.})=-230.5\times[C]+31.6\times[Si]-20.4\times[Mn]-39.8\times[Cu]-18.1\times[Ni]-14.8\times[Cr]+16.8\times[Mo]+912 \quad (2)$$

$$Ms(^\circ\text{ C.})=560.5-\{407.3\times[C]+7.3\times[Si]+37.8\times[Mn]+20.5\times[Cu]+19.5\times[Ni]+19.8\times[Cr]+4.5\times[Mo]\} \quad (3)$$

Here, [C], [Si], [Mn], [Cr], [Mo], [Cu], and [Ni] respectively indicate the contents (mass %) of C, Si, Mn, Cr, Mo, Cu, and Ni. Further, in a case where the elements shown in the respective terms of Equations (1) to (3) are not included, the calculation is performed without the term.

TABLE 1

| BLANK CHEMICAL COMPOSITION (MASS %)* | | | | | | | | | | | |
|---|---|---|---|---|---|---|---|---|---|---|---|
| C | Si | Mn | P | S | Cu | Al | Ni | Cr | Ti | B | N |
| 0.23 | 0.18 | 1.28 | 0.013 | 0.002 | 0.08 | 0.041 | 0.01 | 0.21 | 0.023 | 0.0029 | 0.0041 |

*Balance: Iron and inevitable impurities other than P, S, and N.

After the press-forming process was performed, the metal sheet was air-cooled after being extracted from the forming tool (the "cooling speed after the press-forming process"). The result is show in Table 2.

TABLE 2

| No. | COOLING SPEED (° C./SECOND) FROM HEATING FURNANCE TO COOLING FACILITY | TEMPERATURE ((° C.) BEFORE QUENCHING | QUENCHING METHOD | QUENCHING SPEED (° C./SECOND) | QUENCHING TIME (SECOND) |
|---|---|---|---|---|---|
| 1 | 20 | 840 | GAS-JET | 85 | 4 |
| 2 | 20 | 840 | METAL CLAMPING | 160 | 2 |
| 3 | 20 | 840 | MIST EJECTION | 310 | 1 |
| 4 | — | — | — | — | — |

| No. | PRESS START TEMPERATURE (° C.) | PRESS END TEMPERATURE (° C.) | COOLING SPEED (° C./SECOND) OF PRESS-FORMING MACHINE | COMPONENT FORMING TIMES FOR 1 MINUTE (spm) | VICKERS HARDNESS |
|---|---|---|---|---|---|
| 1 | 471 | 458 | 9 | 8.6 | 483 |
| 2 | 489 | 477 | 9 | 12 | 491 |
| 3 | 499 | 486 | 9 | 15 | 502 |
| 4 | 840 | 180 | — | 2.7 | 505 |

In the test Nos. 1 to 3, the operation efficiency of the forming tool (the pressing machine) was controlled by the conveying time and the quenching time of the metal sheet. That is, since the press-forming process on the precedent metal sheet ends within the conveying time of the subsequent metal sheet, there is no need to consider the press-forming time as in the related art. In this example, since the conveying operation from the heating furnace to the cooling facility (the cooling unit or the cooling zone) and the conveying operation from the cooling facility to the pressing machine are synchronized with each other, the operation efficiency (the time necessary for manufacturing one press-forming product) of the forming tool (the pressing machine) was set to a value obtained by adding the conveying time (3 seconds) to the quenching time.

Further, since the temperature of the steel sheet before the pressing process may be controlled by setting the quenching time of the cooling facility before the press-forming process like the gas-jet method (4 seconds), the metal clamping method (2 seconds), and the mist method (1 second), the number of the pressing operations for 1 minute (the "number of times of component forming process for 1 minute") may be set to each of 8.6 times, 12 times, and 15 times (spm).

According to the test Nos. 1 to 3, satisfactory formability may be obtained, and hence the deep drawing process may be performed at the forming bottom dead center (the state shown in FIG. 1). Further, it is possible to obtain a satisfactory press-forming product without causing a breakage or a crack during the forming process. Further, it is possible to attain 450 Hv or more as Vickers hardness in any case.

According to the comparison with the following reference example (No. 4 in Table 2), in the test Nos. 1 to 3 that satisfies the condition of the present invention, the number of the pressing operations for 1 minute is excellent, and the time (spm) necessary for the press-forming process may be shortened, so that the forming tool operation efficiency may be improved. Thus, according to the present invention, it is possible to manufacture a satisfactory press-forming product having a desired strength with high productivity without causing a breakage or a crack during the forming process.

Reference Example

Test No. 4

The metal sheet having the shame chemical composition as that of Example 1 was heated to 900° C. by the press-forming facility of the related art shown in FIG. 2, was conveyed to the press-forming machine (the forming tool: FIG. 1) (under the condition in which the conveying time was 3 seconds and the temperature of the steel sheet when the pressing process started was 840° C.), and was subjected to the cylindrical deep drawing process as in Example 1. Furthermore, in the reference example, the metal sheet was not cooled by the cooling facility before the pressing process, and the formability was poor. For this reason, the diameter of the metal sheet was set to 90 mm, and the forming height was set to 20 mm. The metal sheet was press-formed while the forming tool was cooled by the cooling medium (water) circulated inside the punch and the die (under the condition in which the forming time was 2 seconds, the forming speed was 50 mm/second, and the distance from the top dead center to the bottom dead center was 100 mm), and was quenched while being held at the forming bottom dead center for 20 seconds. The press-forming condition at this time was set as below.

<Press-Forming Condition>

Folding force: 3 tons

Die shoulder radius rd: 5 mm

Punch shoulder radius rp: 5 mm

Clearance CL between punch and die: 0.15/2+1.0 (steel sheet thickness) mm

Forming height: 20 mm

Pressing machine: hydraulic press (manufactured by Kawasaki oil Industry Co., Ltd., 300 t hydraulic press)

The holding time until the quenching process ended after the metal sheet subjected to the press-forming process was stopped at the forming bottom dead center was 22 seconds. Accordingly, the number of times of the pressing operations for 1 minute was about 2.7 times [2.7 spm (stroke/minute)], the forming tool operation efficiency was poor, and the productivity was low. The result is shown in Table 2.

INDUSTRIAL APPLICABILITY

According to the present invention, it is possible to manufacture a press-forming product having a desired strength with high productivity without causing a breakage or a crack during a press-forming process in a manner such that a metal sheet is heated to a transformation temperature $Ac_1$ or more, the metal sheet is cooled to 600° C. or lower, the metal sheet is formed by a forming tool, the forming process ends at a martensite transformation start temperature Ms or more, the metal sheet is taken out from the forming tool, and the metal sheet is cooled.

EXPLANATION OF REFERENCE NUMERALS

1 punch
2 die
3 blank holder
4, 10 blank (metal sheet)
11 cutout machine
12 heating furnace
13 press-forming machine
14 press-forming product
15 cooling unit

The invention claimed is:

1. A press-forming product manufacturing method of manufacturing a forming product by press-forming a metal sheet using a press-forming tool, comprising:

heating the metal sheet to a transformation temperature Ac1 or more;

cooling the metal sheet to 600° C. or lower;

forming the metal sheet by a cooled forming tool;

ending the forming process at a martensite transformation start temperature Ms or more;

taking out the metal sheet from the forming tool after the forming process is ended; and cooling the metal sheet having been taken out from the forming tool, externally of the forming tool, wherein the forming process is performed by a mechanical press-forming process or a hydraulic press-forming process having a pressing speed of 100 min/second or more.

2. The press-forming product manufacturing method according to claim 1, wherein the cooling process to 600° C. or lower is performed by clamping the metal sheet between metal members.

3. The press-firming product manufacturing method according to claim 1, wherein the cooling process to 600° C. or lower is performed by ejecting a gas and/or a mist.

4. A press-forming facility that includes a heating furnace and a press-forming machine and is used to manufacture a forming product in a manner such that a metal sheet is heated to a transformation temperature Ac1 or more in the heating furnace, and the metal sheet is press-formed by a cooled press-forming machine, wherein a cooling unit that rapidly cools the heated metal sheet is provided inside the heating furnace or between the heating furnace and the press-forming machine, and the press-forming machine is a mechanical pressing machine or a hydraulic pressing machine having a pressing speed of 100 min/second or more and being configured to remove the press formed metal sheet at a martensite transformation start temperature Ms or more.

5. A press-forming product that is obtained by the press-forming facility according to claim 4.

* * * * *